US006573871B2

(12) United States Patent
Drews et al.

(10) Patent No.: US 6,573,871 B2
(45) Date of Patent: Jun. 3, 2003

(54) TRANSPORTABLE SYSTEM AND A METHOD FOR PRODUCING COMMUNICATION CONNECTIONS

(75) Inventors: Detlef Drews, Penig OT Amerika (DE); Klaus Dallinger, Lunzenau (DE)

(73) Assignee: KB Impuls Service GmbH, Penig OT Amerika (DE)

( * ) Notice: Subject to any disclaimer, the term of this patent is extended or adjusted under 35 U.S.C. 154(b) by 83 days.

(21) Appl. No.: 09/868,715

(22) PCT Filed: Dec. 13, 2000

(86) PCT No.: PCT/DE00/04495

§ 371 (c)(1),
(2), (4) Date: Oct. 15, 2001

(87) PCT Pub. No.: WO01/45201

PCT Pub. Date: Jun. 21, 2001

(65) Prior Publication Data

US 2003/0006939 A1 Jan. 9, 2003

(30) Foreign Application Priority Data

Dec. 14, 1999 (DE) ..... 199 61 628
Dec. 14, 1999 (DE) ..... 299 22 358 U
Dec. 12, 2000 (DE) ..... 100 62 607

(51) Int. Cl.[7] ..... H01Q 1/32
(52) U.S. Cl. ..... 343/713; 343/880
(58) Field of Search ..... 343/713, 714, 343/878, 880, 882, 711, 832

(56) References Cited

U.S. PATENT DOCUMENTS 3,377,595 A * 4/1968 Carr et al. ..... 343/713
4,185,288 A * 1/1980 Dosch et al. ..... 343/765
4,309,708 A 1/1982 Sayovitz ..... 343/713
4,320,607 A 3/1982 Eubank ..... 52/143
4,586,052 A * 4/1986 Liley ..... 343/713
4,663,633 A * 5/1987 Wilson ..... 343/714
4,811,026 A * 3/1989 Bissett ..... 343/766
4,833,484 A * 5/1989 Garrood et al. ..... 343/781 CA
4,887,091 A * 12/1989 Yamada ..... 343/714
5,414,435 A 5/1995 Wolf ..... 343/713
5,554,998 A * 9/1996 Sherwood et al. ..... 343/881
5,585,804 A 12/1996 Rodeffer ..... 342/359
5,961,092 A * 10/1999 Coffield ..... 248/539

FOREIGN PATENT DOCUMENTS

| | | |
|---|---|---|
| DE | 3522404 | 1/1987 |
| DE | 9206944.4 | 9/1992 |
| WO | WO98/15027 | 4/1998 |

* cited by examiner

*Primary Examiner*—Don Wong
*Assistant Examiner*—Shih-Chao Chen
(74) *Attorney, Agent, or Firm*—Jordan and Hamburg LLP

(57) ABSTRACT

Transportable, autonomously operating equipment as a network node between networks for transmitting analog, digital and/or pulse-modulated signals in communication connections between a satellite and exchanges for extension stations and/or terminal stations with antennas, modules, walls, doors and/or vent openings, as well as a method for establishing the communication connections by automatically leveling the equipment and calculating the data for controlling the satellite antenna and the north-south position of the equipment.

11 Claims, 3 Drawing Sheets

TRANSPORTABLE SYSTEM AND A METHOD FOR PRODUCING COMMUNICATION CONNECTIONS

BACKGROUND OF THE INVENTION

The present invention relates to transportable equipment as a network node between networks for transmitting analog, digital and/or pulse-modulated signals in communication connections between communication satellites and exchanges for extension stations and/or terminal stations with antennas, locating system, modules, walls, lifting devices, doors and/or vent openings at or in a supporting frame.

The invention furthermore relates to a method, for establishing communication connections between networks by means of an automatically and autonomously operating network node for transmitting analog, digital and/or pulse-modulated signals between a communication satellite and exchanges for extension stations and/or terminal stations with antennas, locating system, modules, walls, lifting devices, doors and/or vent openings at or in a supporting frame.

It is well known that it is possible to communicate with satellites with the help of individual satellite ground stations. Such satellite ground stations consist of individual components and can be installed, operated and maintained only by a special team. They generally consist of the permanently installed antenna and the receiving, processing and transmitting modules, which are installed in a separate building.

Because of their construction, particularly of the free-standing satellite antenna, their use is possible only in certain regions on earth, or additional equipment and instruments must be installed.

It is a particular disadvantage of this equipment that, when used in areas with a heavy snowfall, heating of the antenna is necessary, so that the satellite connection can be brought about or maintained even under these weather conditions.

Furthermore, it is known that, on every point on earth, satellite antennas have a different alignment to the usable and intended communication satellites. For most stationary facilities at transmission rates greater than 64 kbps, the satellite antennas at the present time are aligned manually. At these transmission rates, it is particularly important that the antenna for the transmission by satellite over a large distance must be aligned accurately, so that the required transmission quality is attained.

However, smaller mobile equipment is also known, which is mounted on a vehicle and the antenna of which is also aligned manually.

For example, a mobile telecommunication station is known from the WO 98/15027 for transmitting and receiving radio signals. This station consists of a metal container, in the interior of which there is a lattice mast for the antennas, as well as partitions. In the separate rooms, there are aggregates and generators for operating the mobile station. The lower platform of the metal container is fastened detachably to the body of a vehicle, retractable legs being disposed below at the platform. This arrangement of the legs is particularly disadvantageous, since these legs are not integrated in the interior of the metal container. Accordingly, transporting the container by rail, aircraft, ship or truck with loading platforms is possible only to a limited extent, since the retractable legs must be dismantled for transport.

Furthermore, it is a disadvantage that, although equipment and modules for a radio relay transmission are present in the container, the transmission links must first be brought about at great effort. The antennas must first be mounted on site at the extendable lattice mast and the alignment to the next radio station is made manually.

From the U.S. Pat. No. 4,320,607, it is known that supporting legs may be mounted for transporting heavy large parts, such as concrete panels. Especially the fact that, due to the arrangement of the supporting legs, the width of the transported material is enlarged, resulting in an even more excessive width, is a disadvantage here.

The arrangement of small satellite receiving antennas for radio and television reception on vehicles, as described in the German utility patent GM 92 06 944 U1, is also known. The receiving antenna is mounted on the roof of the vehicle and the parabolic mirror can be folded over, so that the air resistance while driving is small. The parabolic mirror is set up and aligned with a lifting and rotating unit with servomotors, which are additionally mounted on the roof and can be operated from the interior of the vehicle. The height of the vehicle is increased by the lifting and rotating unit and by the antennas. This arrangement is suitable only for small receiving antennas and not for the transmitting and receiving antennas with high transmission rates.

SUMMARY OF THE INVENTION

With this state of the art as background, it is an object of the invention to provide transportable equipment as a network node between networks and a method for producing transmissions of analog, digital and/or pulse-modulated signals in communication connections between communication satellites and exchanges for extension stations and/or terminal stations, which make possible an automatic and autonomous starting up of the systems of the telecommunication and data transmission technique as well as an independent unloading and loading of transporting means.

Pursuant to the invention, this object is accomplished by equipment and a method with the distinguishing characteristics of the main claim and their further development in the additional claims with their distinguishing characteristics.

The invention is distinguished, above all, by the fact that a network and communication infrastructure with high transmission rates of more than 64 kbps can be set up rapidly and independently of the position of the area in which it is used and requires no additional rooms to accommodate the interior units of the ground station and no specially trained personnel on site.

Because of the generating set and the air-conditioning unit, which are installed, and the developed satellite antenna, the inventive equipment with its satellite modules, telecommunication modules and data modules can be used at any place on earth, independent of natural environmental parameters, such as snowfall or high external temperatures.

In accordance with requirements, the inventive equipment is equipped with satellite, telecommunication and data modules with integration of DEC (digital European cordless) and/or GSM (global system for mobile communication) solutions. However, the integration of data solutions, video conferencing solutions and/or the transmission of medical-technical transmission solutions is also possible.

It is particularly advantageous that the inventive equipment is transportable equipment on a supporting frame as a network node between networks for transmitting analog, digital and/or pulse-modulated signals in communication connections between communication satellites and exchanges for extension stations and/or terminal stations with antennas, locating systems, modules and lifting devices.

It is a further advantage of the invention that, as network node, the equipment preferably has a size, the dimensions of which correspond to a standard 20' container. Since no additional directly attached constructions or superstructures are present in the transporting state, it is particularly easy to transport the equipment and this can be accomplished without problems with all transporting means.

Pursuant to the invention, the equipment is a network node on or in a supporting frame, in which profiled supports are dispose by a friction-type connection. It has proven to be advantageous to disposed the profile supports close to the corners of the supporting frame and preferably parallel to the front sides. In the profile supports, lifting supports are displaceably disposed and can be extended to the outside. At the outer ends of the lifting supports, there are the lifting devices, at the lower edge of which of the lifting device rods, additional ground plates may be mounted. In the retracted state, the motor and the actual lifting rod, which are extended downward, are above the lower lifting support edge. In the retracted state, the lower edge of the lifting device rod terminates with the lower edge of the lifting support.

Pursuant to the invention it is possible by these means to retract the lifting supports with the disposed lifting devices to such an extent, that the latter, in the retracted state, do not protrude beyond the external dimensions of the supporting frame and instead are in the lifting device spaces at the outside of the equipment.

It is advantageous if the profiled supports extend over the whole width of the supporting frame and, as a result, the two outer edges of the supporting frame are additionally connected by these means with the wing spar.

It is particularly advantageous that the lifting supports can be extended to such an extend with the lifting devices out of the profiled supports, that, in the extended state, the lifting device rods of the lifting devices are outside of the loading width of the transporting means. Ground plates, which are required in case of need, can be connected with the lifting device rods, provided that the structure of the ground makes it necessary. It is a further advantage that the ground plates can be dismantled at the lifting device rods before the retraction, so that there are no space problems with the lifting devices in the lifting device space of the equipment.

After the lifting supports are extended, the inventive equipment is lifted from the transporting means by the lifting devices, so that the transporting means can be removed without problems. The equipment is leveled precisely in the horizontal direction and in the vertical direction by the leveling module, which is integrated in the equipment, by controlling the individual lifting devices by the lifting device rods. This exact leveling is a prerequisite so that subsequently calculations can be made for controlling the automatic alignment of the satellite antenna with the communications satellite.

A storage space module for seating the satellite antenna base and its stabilization struts was assigned centrally over the whole width of the supporting frame. Preferably, a satellite antenna, which is designed as a multiband offset antenna system, is installed on the satellite antenna base. The alignment of the satellite antenna is controlled by the ascertained data of the integrated measurement and control module and of the locating system.

Preferably, the geographic location of the equipment is calculated from the data of the global positioning system (GPS) in real time and the north-south direction is determined from the data obtained from the compass. It is particularly advantageous if an electronic compass is used, in which the data of the local magnetic fields can also be taken into consideration.

After the equipment is leveled and the data of the geographic location are subsequently compared with the north-south direction and with the position of the communication satellite used, the alignment of the satellite antenna is controlled. After the coordinates are determined, the control system automatically aligns the parabolic mirror of the antenna precisely to the position of the satellite used.

After communication between the satellite and the equipment has been established, it is also possible, pursuant to the invention, to track the antenna over this connection.

It has turned out to be advantageous if the maximum height of the storage space module of the satellite antenna is such that the satellite antenna, during transport or while inactive, terminates below the inner edge of the roof. The satellite antenna base preferably is fastened centrally and the satellite struts preferably are fastened to the upper corners of the storage space module. However, other fastening points are also possible. The storage space module can be reinforced additionally by load absorbing supports in the interior at the outer corners.

Above the satellite antenna, there is a roof which can be opened. Preferably, the roof is opened approximately over the whole area, in which the satellite antenna with the parabolic mirror and the horn radiator are located in the inactive position. Roofs, which are constructed as folding or sliding roofs, are preferred.

The parabolic mirror and the horn radiator of the satellite antenna can be swiveled vertically from the inactive position up to an angle of 150°. However, it has turned out that satellite antennas, the parabolic mirror and horn radiator which can be swiveled up to an angle of 132° are preferred.

It is particularly advantageous if the satellite antenna can be rotated horizontally on the satellite antenna base by an angle of 360°.

On the one side of the storage space module, there is the aggregate module, in which advantageously at least one generating set and/or an electrical connecting and distributing station are disposed.

In addition, air conditioning equipment, which is able to cool all models and aggregates of the network node, is additionally installed in equipment, which is to be set up in areas, in which high outside temperatures occur.

At the other side of the storage space module, the operating module with the integrated and measurement and control module and the locating system is disposed, which also establishes the communication connections with the satellite and with the PSTN (Public Switched Telephone Network), ISN (Integrated Services Network) and/or ATM (asynchronous transfer mode) and processes the signals.

By means of an antenna, preferably an extendable omnidirectional antenna and/or a cable network, communicating with the terminal stations, such as radio-controlled telephone booths, dial-in handsets or, over line networks, with computers, faxes, etc., is established by the operator module. By means of the operator module, this network can also carry out communications among several terminal stations in a completely stand alone manner, if this takes place locally. Preferably the operator module consists of a HICOM CORDLESS SYSTEM or a GSM (Global System for Mobile Communication); however, other systems are also possible.

It is the special advantage of the inventive method that communication connections with transmission rates of more than 64 kbps can be established and operated automatically and autonomously. However, lower rates of transmission are also possible.

Pursuant to the method, the equipment, after it has reached its place of destination, either is connected as a network node to the electrical network or to the generating set, present in the network node, is switched on.

Pursuant to the method, the lifting supports with the lifting devices in the profiled supports are extended first and started up. It is a special advantage that, because it has its own power supply and lifting device, the equipment can be removed from the transporting vehicle without outside contrivances.

Pursuant to the invention, after removal of the transporting means, the leveling module, integrated in the equipment of the network node, is started up. It controls the motors of the lifting devices individually in such a manner, that the equipment can be aligned horizontally as well as vertically exactly level, by means of the lifting device rods.

After receiving data from the Global Positioning System (GPS) in real time, the inventive method enables the geographic location to be determined. At the same time, the data of the north-south direction are determined by means of a compass, preferably an electronic compass.

From the comparison of this data in the control module after the equipment is leveled with the position of the communication satellite, which is to be used, the control data are calculated and the satellite antenna is controlled by the control module in the horizontal and vertical levels in such a manner, that it is aligned exactly with the communication satellite and the operator module establishes the communication connection with the satellite and the PSTN (Public Switched Telephone Networks), ISDN (Integrated Services Digital Network) and/or ATM (Asynchronous Transfer Mode).

The signals received are passed on to the operator module, processed there and subsequently passed on over an antenna in wireless fashion to the terminal stations, such as wireless dial-in handsets, telephone booths over a supply network to terminals, such as computers, faxes, etc.

Further advantages, details and characteristics, essential to the invention, arise with reference to the drawings attached.

BRIEF DESCRIPTION OF THE DRAWINGS

The invention is to be described in greater detail below by means of an example. In the drawings

DETAILED DESCRIPTION OF TEE INVENTION

Figure 1:
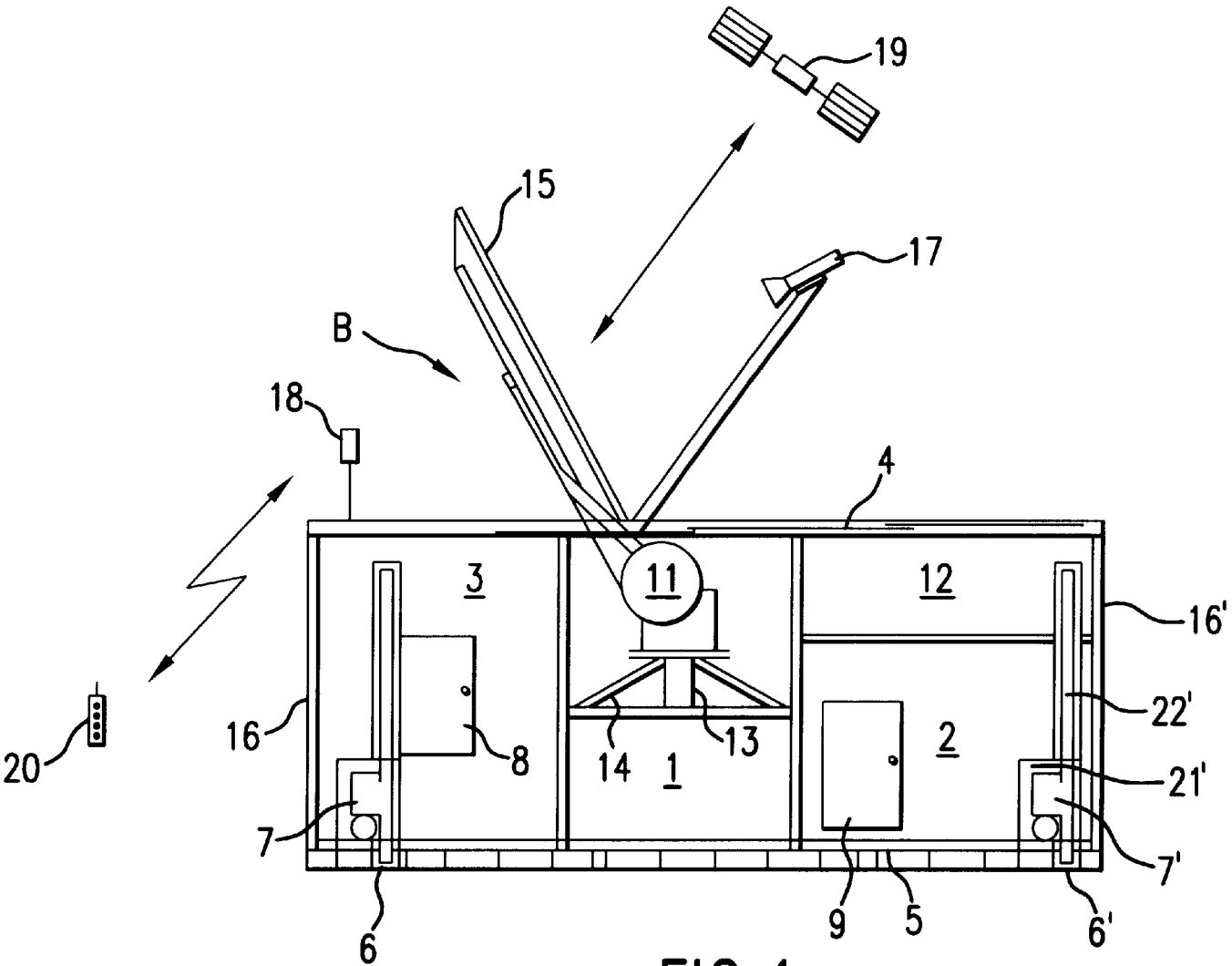
FIG. 1 shows a diagrammatic representation of the equipment in a side view in the operating state.

The inventive equipment consists essentially, as shown in FIG. 1, of a network node with walls 16 on a supporting frame. Profiled supports 6 are non-positively disposed in the vicinity of the front walls.

Figure 3:
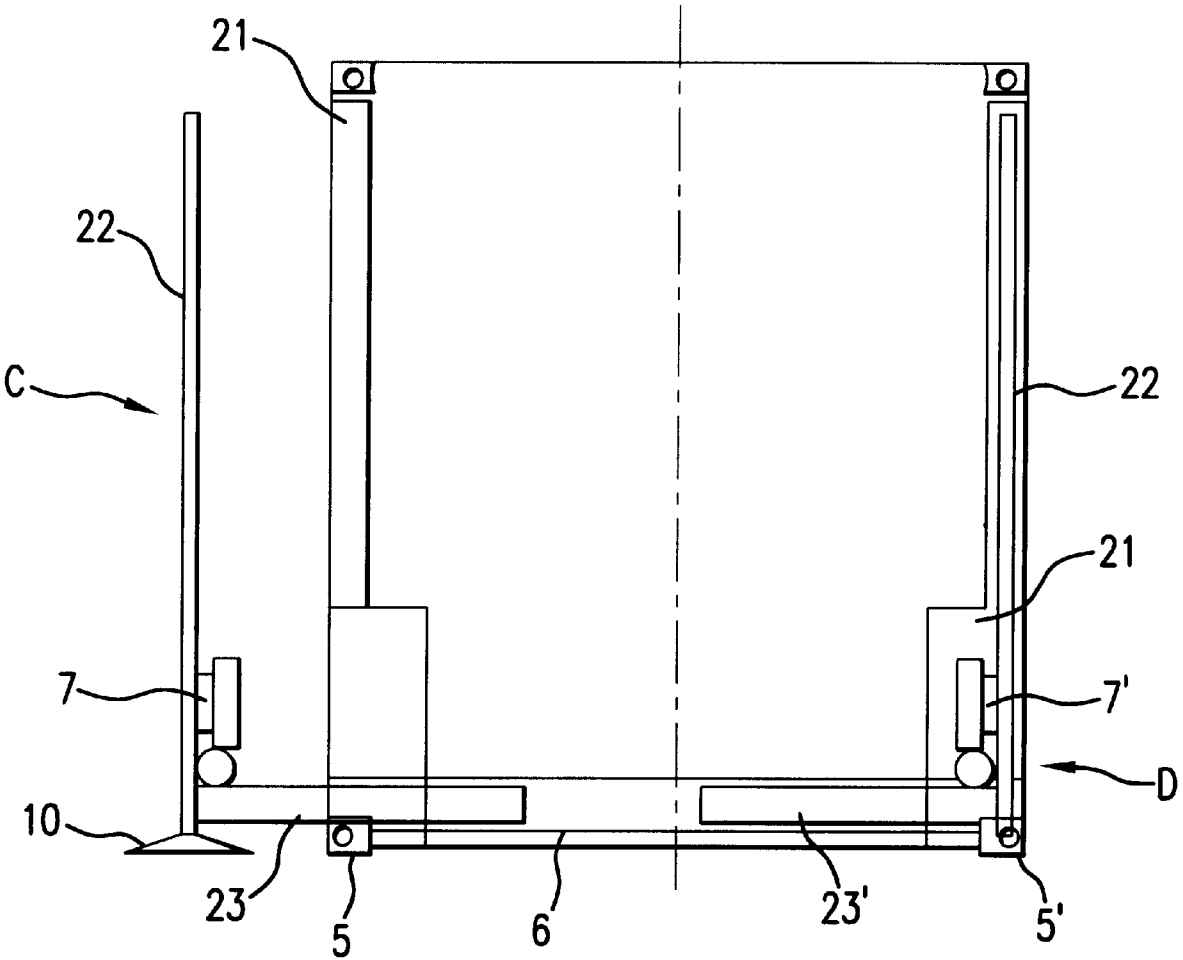

As can be seen from FIG. 3, the profiled supports 6 are disposed over the whole width of the supporting frame and connect the two wing spars 5, 5'. The profiled supports 6, 6', at the same time have the function of guiding the lifting supports 23, 23' with the lifting devices 7, 7'. Accordingly, the lifting device 7 at the lifting support 23 can be moved so far to the outside, that the mounted ground plate 10 protrudes over the transporting means, which are not shown. In the extended state C, the lifting process takes place by means of the lifting device 7 and the lifting device rod 22. In this example, there is a detachable ground plate 10 at each lifting device 7, so that the equipment stands securely depending on the condition of the ground. The lifting support 23' is in the retracted state D in the profiled support 6 and, with that, the lifting device 7' and the lifting device rod 22 are in the lifting device space 21 within the outer dimensions of the equipment.

As can furthermore be seen from FIG. 1, a storage space module 1, to which the satellite antenna base 13 for the satellite antenna 11 is fastened, is disposed centrally on the supporting frame with wing spars 5. The satellite antenna base 13 is fastened centrally on the storage space module 1 and fastened additionally by stabilizer struts 14 in the direction of all four corners on the storage space module 1. The parabolic mirror 15 and the horn radiator 17 are in the working position B.

Figure 2:
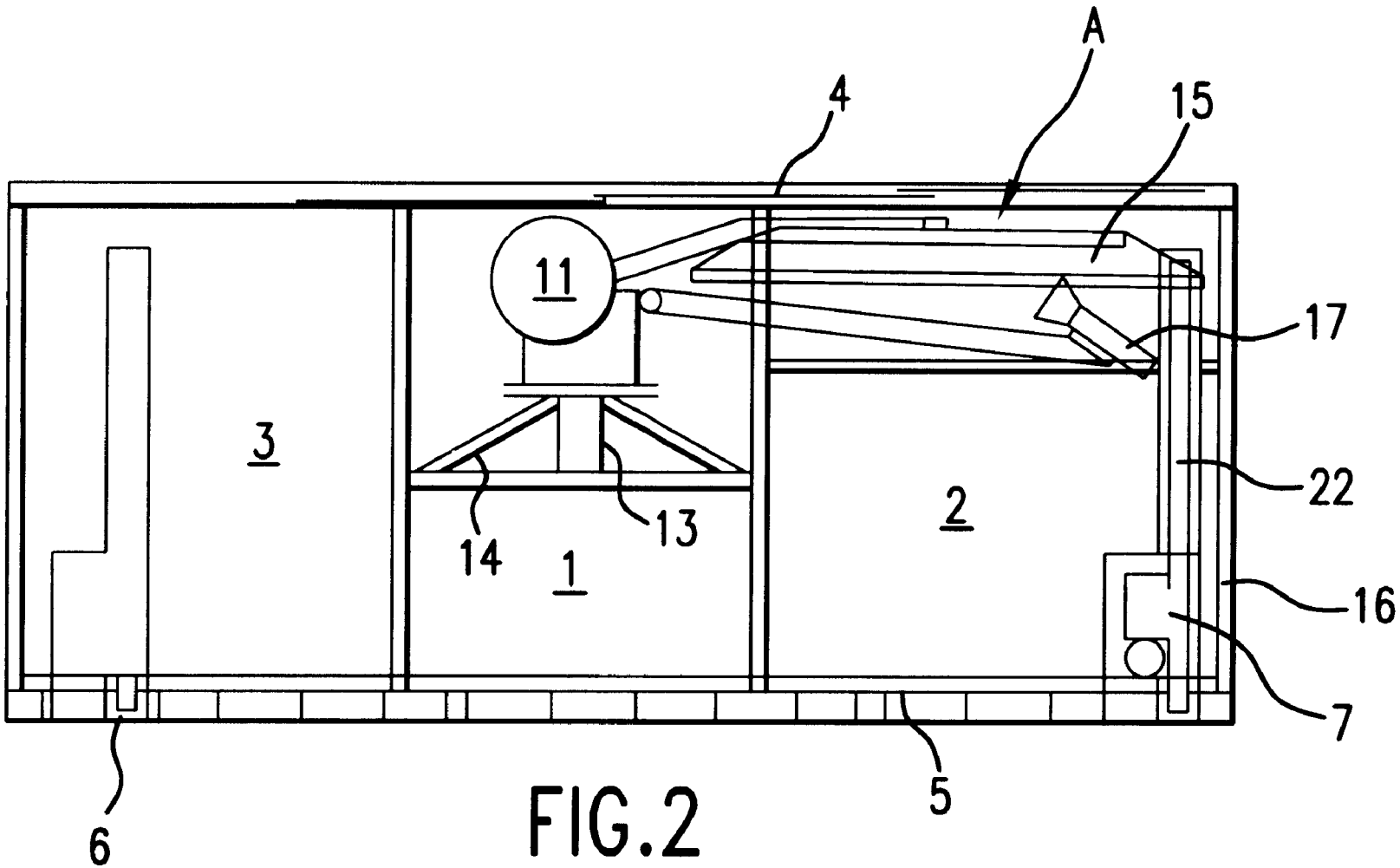
FIG. 2 shows a diagrammatic representation of the equipment in a side view in the transporting and inactive state and FIG. 3 shows a diagrammatic representation of the lifting device in the extended and retracted states.

Next to the storage space module 1, there is the aggregate module 2, in which the generating set and an electrical connecting and distributing station as well as an air conditioning unit are located. Above the aggregate module 2, there is the space 12 for the parabolic mirror 15 and the horn radiator 17 during transport or in the inactive position A (see FIG. 2).

The operation module 8, with the integrated measuring and control module and the locating system is in a separate space.

After the equipment has been leveled horizontally and vertically with the help of a leveling system and the control of the individual lifting devices 7 at the lifting device rods 22, the integrated locating system GPS determines the geographic location and the electronic compass in the measurement and control module determines the north-south direction of the equipment of the network node. From a comparison of the data, the control module, after determining the position of the communication satellite that is to be used, calculates the control data for controlling the satellite antenna. After these data are calculated the roof 4, which in this example is constructed as a sliding roof, is opened.

After the roof 4 is opened, the vertical and horizontal alignment of the parabolic mirror 15 by means of the lifting and rotating unit with the integrated servo motor of the antenna onto the satellite to be used, over which the connection to the PSTN, ISN or ATM is to be established, takes place automatically on the basis of the calculation by the integrated measurement and control system.

The signals are worked up in the operator module 3, which is on the other side of the storage space module 1, and subsequently passed on by means of an extendable omnidirectional antenna 18 or over a supply network directly to the terminal station 20. A HICOM CORDLESS SYSTEM was used in this example as the operator module 3.

| List of Reference Symbols | |
|---|---|
| storage space module | 1 |
| aggregate module | 2 |
| operator module | 3 |
| roof | 4 |
| wing spar | 5 |

-continued

| List of Reference Symbols | |
|---|---|
| profiled support | 6, 6' |
| lifting device | 7, 7' |
| access door to operator module | 8 |
| ground plate | 10 |
| satellite antenna | 11 |
| space for parabolic mirror and horn radiator | 12 |
| satellite antenna base | 13 |
| stabilizing struts | 14 |
| parabolic mirror | 15 |
| wall | 16, 16' |
| horn radiator | 17 |
| antenna | 18 |
| satellite | 19 |
| end position | 20 |
| lifting device space | 21, 21' |
| lifting device rod | 22, 22' |
| lifting support | 23, 23' |
| inactive position | A |
| working position | B |
| extended state | C |
| retracted state | D |

What is claimed is:

1. Transportable apparatus for use as a network node between networks for transmitting analog, digital and/or pulse-modulated signals in communication connections between a communication satellite and exchanges for extension stations and/or terminal stations, comprising a) profiled supports which are disposed horizontally in a supporting frame in which moveable lifting supports are located with non-positively disposed lifting devices comprising rods, b) a leveling system controlling the lifting device rods individually by means of the lifting devices, c) a satellite antenna disposed in the inactive state within the equipment underneath an openable roof on a storage space module, d) an operator module with an integrated measurement and control module and a locating system for calculating the geographic location in real time for determining the north-south direction and for calculating data for controlling the satellite antenna relative to the position of the communication satellite.

2. The apparatus of claim 1, wherein a lower edge of one of the lifting devices terminates at an outer end of the lifting support in a retracted state and is located within outer dimensions of the supporting frame.

3. The apparatus of claim 1, wherein the lifting support with the lifting devices are extendable individually to the outside from the profiled supports.

4. The apparatus of claim 1, wherein the satellite antenna is a multiband offset antenna system.

5. The apparatus of claim 4, wherein the satellite antenna is a 2.4 m multiband offset antenna system.

6. The apparatus of claim 1, wherein the locating system is a global positioning system and comprises an electronic compass.

7. The apparatus of claim 1, wherein the openable roof is a folding or sliding roof.

8. A method of operating apparatus according to claim 6 for producing communication connections between networks by means of a network node for transmitting analog, digital and/or pulse-modulated signals between a communication satellite and exchanges for extension stations and/or terminal stations, comprising (a) leveling the apparatus horizontally and vertically to a level position, (b) calculating the geographic location of the equipment from the data of the global positioning system in real time, (c) determining the north-south direction from the data of the compass, (d) calculating the data for controlling the alignment of the satellite antenna with the communication satellite after comparing the data of the location, the north-south direction and the position of the communication satellite, and (e) aligning the satellite antenna with the communication satellite and establishing the communication connections with at least one of public switched telephone networks, integrated services digital network and asynchronous transfer mode.

9. The method of claim 8, wherein the leveling of the apparatus is controlled centrally and takes place separately over the individual lifting devices with the lifting device rods.

10. The method of claim 8, wherein, for the determination of the geographic location, the signals of the global positioning system satellite are measured and processed in real time in the measurement module and the data for controlling the satellite antenna are calculated in the control module.

11. The method of claim 8, wherein a HICOM cordless system or a global system for mobile communication is used as the operator module for establishing the communication connections.

* * * * *